US006604792B1

(12) United States Patent
Picard

(10) Patent No.: US 6,604,792 B1
(45) Date of Patent: Aug. 12, 2003

(54) SEAT ASSEMBLY AND APPARATUS FOR RELEASABLY RETAINING A DIAPHRAGM TO BE USED AS A SEAT

(75) Inventor: Ronald Picard, Watertown, CT (US)

(73) Assignee: Franklin Products, Inc., Torrington, CT (US)

( * ) Notice: Subject to any disclaimer, the term of this patent is extended or adjusted under 35 U.S.C. 154(b) by 50 days.

(21) Appl. No.: 09/707,563

(22) Filed: Nov. 7, 2000

(51) Int. Cl.[7] ..... A47C 7/02
(52) U.S. Cl. ..... 297/452.56
(58) Field of Search ..... 297/452.56, 440.4, 297/204, 205

(56) References Cited

U.S. PATENT DOCUMENTS

| | | | | |
|---|---|---|---|---|
| 610,429 | A | * | 9/1898 | Cochrane |
| 2,832,398 | A | | 4/1958 | Liljengren |
| 3,273,877 | A | | 9/1966 | Geller et al. |
| 3,289,220 | A | * | 12/1966 | Grimshaw |
| 3,399,883 | A | | 9/1968 | McKey |
| 3,589,763 | A | | 6/1971 | Reeves |
| 4,431,229 | A | * | 2/1984 | Unger |
| 4,702,522 | A | | 10/1987 | Vail et al. |
| 4,712,834 | A | | 12/1987 | Warrick |
| 5,445,254 | A | * | 8/1995 | Charles |
| 5,582,463 | A | | 12/1996 | Linder et al. |
| 5,735,578 | A | | 4/1998 | Penley |
| 5,879,050 | A | * | 3/1999 | Marui |
| 6,030,040 | A | * | 2/2000 | Schmid et al. |

* cited by examiner

*Primary Examiner*—Milton Nelson, Jr.
(74) *Attorney, Agent, or Firm*—McCormick, Paulding & Huber LLP

(57) ABSTRACT

A seat assembly includes a chair frame with spaced supports for holding a diaphragm to the frame, where the diaphragm has one edge connected to one of the spaced supports of the chair frame, and an opposite edge of the diaphragm adjacent to another of the spaced supports of the chair frame. The seat assembly also includes an over center linkage for releasably coupling the opposite edge of the diaphragm to the another of the spaced supports of the chair frame for stretching the diaphragm between the spaced supports of the chair frame.

12 Claims, 4 Drawing Sheets

SEAT ASSEMBLY AND APPARATUS FOR RELEASABLY RETAINING A DIAPHRAGM TO BE USED AS A SEAT

FIELD OF THE INVENTION

The present invention relates generally to a method and apparatus for assembling a seat, and more specifically to a method and apparatus for fastening a flexible diaphragm to a seat frame which permits easy assembling and maintenance.

BACKGROUND OF THE INVENTION

Seats must be comfortable and maintainable. The way a seat cushion and a seat frame work together, and how they are maintained in service, are critical to occupant comfort. More particularly, airplane seats and seat components must take into account weight, space availability, durability and cost constraints.

Many airplane seats include a seat diaphragm, which is the surface of the seat frame that comes into contact with the seat cushion. There are two types of seat diaphragm designs that have been used by seat manufacturers, fixed diaphragms and flexible diaphragms. Fixed diaphragms are typically made of flat or contoured sheet metal or composite materials such as fiberglass, and are typically easy to maintain, but not particularly comfortable. In addition, seats with fixed diaphragms can be relatively heavy and expensive.

Flexible diaphragms have been designed in a number of different styles, such as nylon fabric panels attached to front and rear parts of the seat frame, attached to side parts or to both the side parts and the front and rear parts. Other flexible diaphragms include stretchable synthetic materials which are attached to the front and rear parts of the seat frame, attached to the side parts, or attached to both the side parts and the front and rear parts. As compared with fixed diaphragms, flexible diaphragms can provide added comfort. However, flexible diaphragms typically require maintenance, including periodic tightening, since loosening or stretching of the flexible diaphragm may occur while the diaphragm is in service.

While it is known that, the maintenance of flexible diaphragms may be reduced by stretching the flexible diaphragm during installation to minimize stretching that occurs during service, existing mechanisms for this purpose are difficult to use, require separate tools, or are complicated and expensive in design and manufacture, and add significant weight to the seat assembly.

Based on the foregoing, it is an object of the present invention to provide an apparatus and method for stretching a flexible seat diaphragm that overcomes the difficulties and drawbacks associated with prior art seat assembling methods.

It is a more specific object of the present invention to provide a simple and inexpensive device for assembling a seat which permits assembling a flexible diaphragm to a seat frame with a minimum amount of effort and allows for easy maintenance of the flexible diaphragm while in service.

SUMMARY OF THE INVENTION

The invention is directed to a seat assembly which includes a chair frame which has spaced supports for holding a diaphragm to the frame, where the diaphragm has one edge connected to one of the spaced supports of the chair frame, and an opposite edge adjacent to another of the spaced supports of the chair frame. The seat assembly further includes an over center linkage for releasably coupling the opposite edge of the diaphragm to the another of the spaced supports of the chair frame in order to stretch the diaphragm between the spaced supports of the chair frame.

DETAILED DESCRIPTION OF THE PREFERRED EMBODIMENTS

Figure 1:
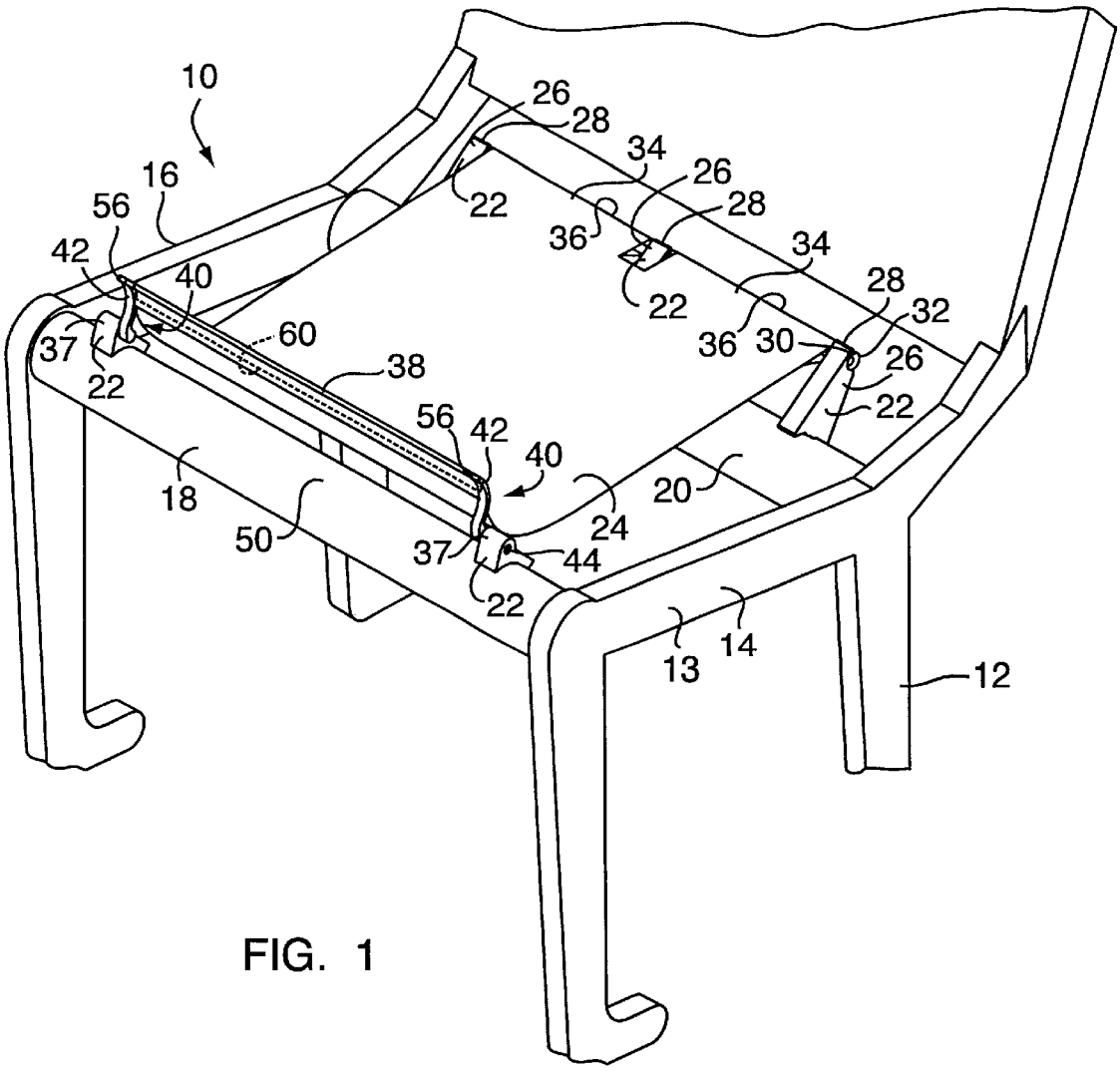
FIG. 1 is a perspective front view of a seat assembly showing a flexible diaphragm in an unstretched position in accordance with the present invention.

FIG. 1 illustrates a seat assembly 10 according to one embodiment of the present invention. The seat assembly 10 includes a chair frame 12 and a seat bottom frame 13 having opposing side members 14, 16, respectively, coupled to front and rear opposing members 18, 20, respectively. Supports 22 are spaced around the chair frame 12 and provide structural support for anchoring a flexible diaphragm 24 to the chair frame 12. In operation, a seat cushion (not shown) is placed on top of the flexible diaphragm 24 for added comfort. The rear member 20 includes three rear supports 26 spaced along and attached to the longitudinal length of the rear member 20 at the mounted ends 27 of the rear supports 26. The rear supports 26 extend upward and to the rear of the rear member 20 to enlarge a seating area while preserving legroom for the occupant sitting behind the seat assembly 10.

Figure 2:
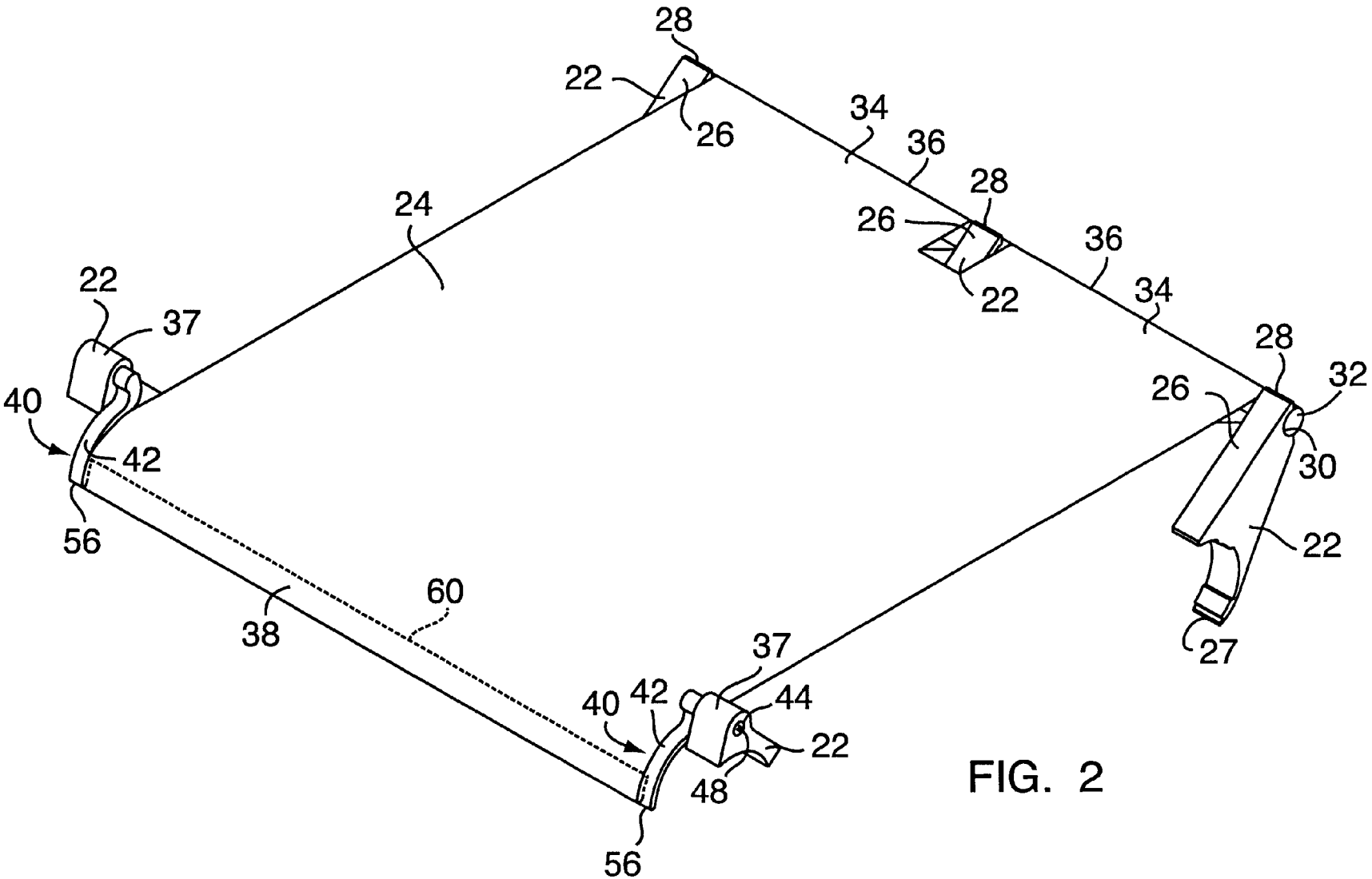
FIG. 2 is a perspective view of the seat assembly of FIG. 1 without a chair fame showing the flexible diaphragm in a stretched position.
Figure 3:
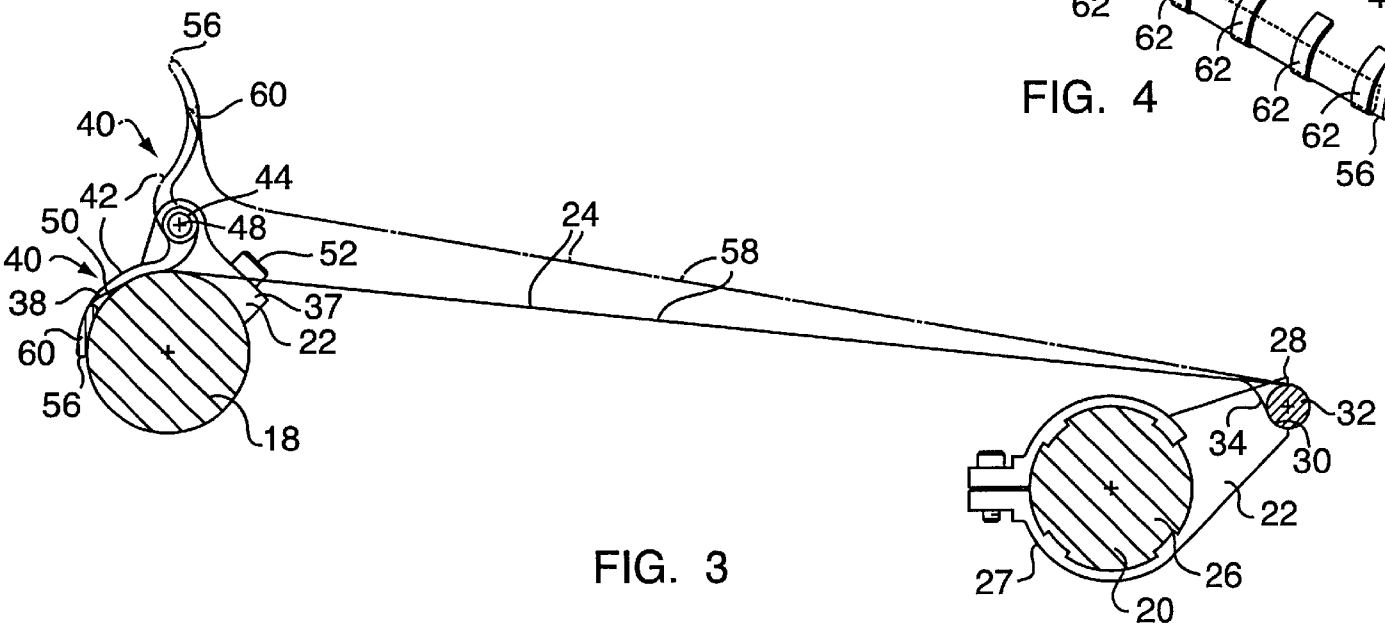
FIG. 3 is a diagrammatic side view of another embodiment of a seat assembly with a flexible diaphragm.

Referring to FIGS. 1, 2 and 3, the diaphragm 24 is connected to free ends 28 of the rear supports 26. While three rear supports have been shown and described, the present invention is not so limited, as there may be any number of rear supports, without departing from the broader aspects of the present invention.

As shown by FIGS. 1 and 2, each of the rear supports 26 include a channel 30 adapted to fixedly hold a rear support rod 32 which extends between and through each of the rear supports 26. The rear support rod 32 is inserted through two rear sleeves 34 formed in a rear edge 36 of the diaphragm 24, and disposed in the channel 30 for securing the diaphragm to the rear member 20. The channel 30 is positioned so that the rod 32 is secured in the channel by pressure exerted on the rod 32 by the diaphragm 24. As will be appreciated, the channel 30 allows the rear support rod 32 and diaphragm 24 to be easily removed from the chair frame 12 for maintenance or replacement.

While a diaphragm secured to a rear rod has been shown and described, the present invention is not so limited as other alternative fastening mechanisms, such as the diaphragm being directly attached to a member or fastened directly to supports, by either removable means, or nonremoveable means, such as staples, glue or nails, may be utilized without departing from the broader aspects of the present invention.

As shown in FIGS. 2 and 3, the flexible diaphragm 24 is preferably made of a stretchable synthetic material, or the like, for stretching between the supports 22 on the chair frame 12. While the rear edge 36 of the diaphragm is connected to the rear supports 26, an opposing front edge of the diaphragm 24 is adjacent to front supports 37. In this stretched position, the diaphragm 24 extends from the rear supports 26 to and over the front member 18. As discussed previously, the stretching of the flexible diaphragm 24 during installation reduces the need for maintenance by minimizing the stretching that occurs during service.

Referring to FIGS. 1 and 2, the diaphragm 24 includes a front sleeve 38 for coupling the diaphragm to an over center linkage 40, as will be described in more detail later. While tensioning the diaphragm between front members and rear supports been shown and described, the present invention is not so limited, as the diaphragm may be tensioned between side supports, or between side supports and front and rear supports, without departing from the broader aspects of the present invention.

An important aspect of the present invention is the use of the over center linkage to tension the diaphragm. Continuing to refer to FIGS. 1 and 2, the over center linkage 40 provides an easy to use device for coupling the front edge of the diaphragm 24 to the front supports 37 of the chair frame 12, and for tensioning the diaphragm during installation, and subsequently holding the diaphragm stretched during service. The over center linkage 40 includes a lever arm 42 which is adapted for pivotal movement around a pin 48 which is attached to or integrated with the front support 37. In operation, the lever arm 42 pivots between an open and closed position for stretching and releasing the diaphragm 24.

As shown best in FIGS. 2 and 3, the lever arm 42 has an arcuate shape to be adjacent to and conform to a partial circumference 50 of the front member 18 so that the lever arm is unobtrusive to an occupant of the seat assembly 10 when the over center linkage 40 is in the closed position. Any technique that causes a closed lever arm to not be noticeable to an occupant, such as recessing a closed lever arm in a groove in a member, is considered within the scope of the invention. Each of the front supports 37 is secured to the front member 18 such that the front supports 37 are disposed on either side of the diaphragm 24 when the over center linkages 40 are in the closed and tensioned position. Each of the front supports 37 is secured to the front member 18 with a fastener 52, such as a screw 52, although many other types of fasteners may be employed.

FIGS. 1, 2 and 3, show a free end 56 of the lever arm 42 coupled to the front sleeve 38 of the diaphragm 24 such that the diaphragm 24 is unstretched when the over center linkage 40 is in the open position, as shown in the phantom lines in FIG. 3. When the over center linkage 40 is in the closed position, the diaphragm 24 is stretched a predetermined amount to reduce maintenance requirements. The over center linkage 40 is in the closed position when the free end 56 of the lever arm 42 abuts the front member 18 and the pressure of the stretched diaphragm 24 pulls the lever arm 42 against the front member 18. The over center linkage 40 is in the open position when the free end 56 of the lever arm 42 is pivoted away from the front member 18 so that the pressure exerted by the diaphragm 24 upon the over center linkage 40 pulls the free end 56 of the lever arm 42 away from the closed position.

As shown in FIGS. 2 and 3, two over center linkages 40 are spaced apart to allow passage of the diaphragm 24 and coupled to the front member 18. Each of the over center linkages 40 are connected together at the free ends 56 of the lever arms 42 by a lever connecting rod 60. The front sleeve 38 of the diaphragm 24 encloses the rod 60 and couples the diaphragm 24 to the rod 60 and the linkages 40. While two over center linkages have been shown, the present invention is not so limited, as there may be any number of over center linkages coupled to the diaphragm without departing from the broader aspects of the present invention.

Figure 4:
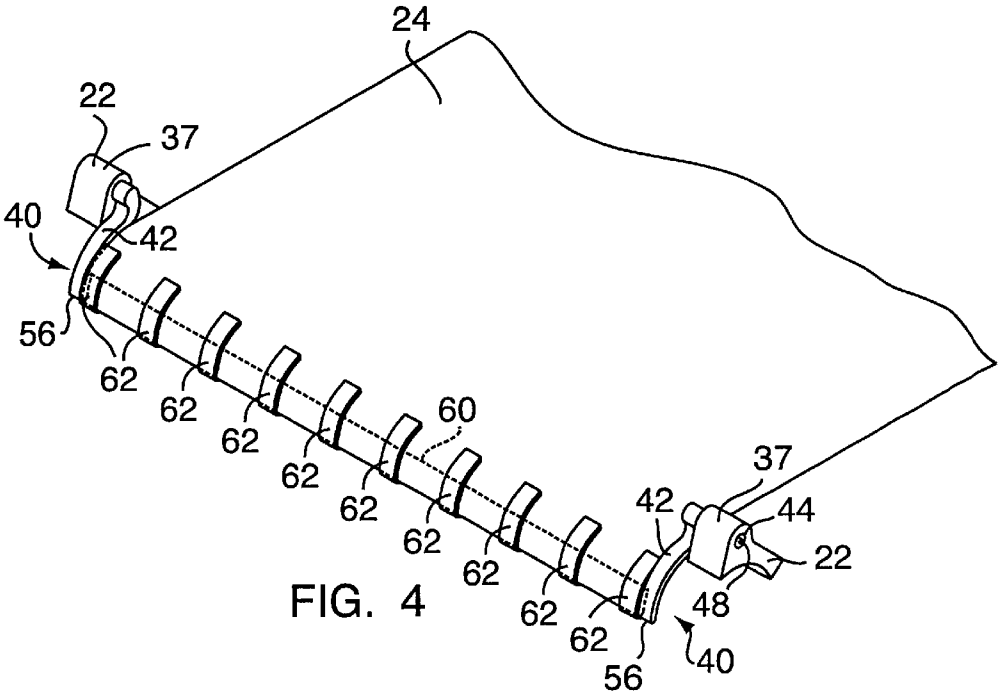
FIG. 4 is a top partial plan view of another embodiment of a seat assembly having j-clips and showing the flexible diaphragm in a partial stretched position.

Referring to FIGS. 2 and 4, while sleeves 38 for coupling the diaphragm 24 to an over center linkage 40 or to rods 32, 60, spaced supports 22 or members 14, 16, 18, 20 have been shown and described, the present invention is not so limited, as other means for coupling the diaphragm to the seat assembly 10, such as J-clips 62, can be used without departing from the broader aspects of the present invention. While an over center linkage coupled to spaced supports has been shown and described, the present invention is not so limited, as the over center linkage may be attached to a support, directly coupled with a member, or integrated into a member, without departing from the broader aspects of the present invention.

As shown in FIG. 6, a front j-channel 64 removably secures the diaphragm 24 to the lever connecting rod 60, and a rear j-channel removably secures the rear edge 36 of the diaphragm 24 to the rear supporting rod 32. The front 64 and rear 66 j-channels are j-shaped sections of plastic which can be molded to fit over the shape and size of the rods 32, 60 to which the j-channels connect. When utilized by the present invention, the channel section of the j-channel 64, 66 fits partially around the rod 32, 60 to which it 64, 66 connects, and can be quickly and easily be applied to or removed from the rod 32, 60. The diaphragm 24 can be coupled to the j-channels 64, 66 by sewing the diaphragm 24 to the plastic j-channels 32, 60. J-channels may be used to couple multiple edges of the diaphragm to rods and supports, or a j-channel may be used on only one edge of the diaphragm, without departing from the broader aspects of the present invention.

As shown in FIGS. 1 and 3, the lever connecting rod 60 may act as a handle for opening and closing the linkages 40 and stretching and unstretching the diaphragm 24. No separate tools are required to stretch or release the diaphragm. In operation, the closing of the over center linkage 40 stretches the diaphragm 24 by a predetermined amount until the plane 58 of the diaphragm rotates past the pivot point 48 of the lever arm 42. The over center linkage 40 is retained in the closed position by abutment of the lever arm 42 against the front member 18 and pressure exerted upon the lever arm 42 by the stretched diaphragm 24. At this point, mechanical forces hold the lever arm 42 and the diaphragm 24 in place, as referred to previously.

Continuing with FIGS. 1 and 3, to release the diaphragm 24, the lever arms 42 are rotated back to the open position by grasping the lever connecting rod 60 and pivoting the over center linkage to the open position, thereby rotating the diaphragm past the pivot point of the lever arm. The diaphragm 24 may be easily removed from the lever connecting rod 60 by disengaging the sleeves from the lever connecting rod 60. The diaphragm 24 is easily removed from the rear support rod 32 by displacing the rod 32 from the channel 30 and the removing the rod 32 from the rear sleeves 34 of the diaphragm 24.

Figure 5:
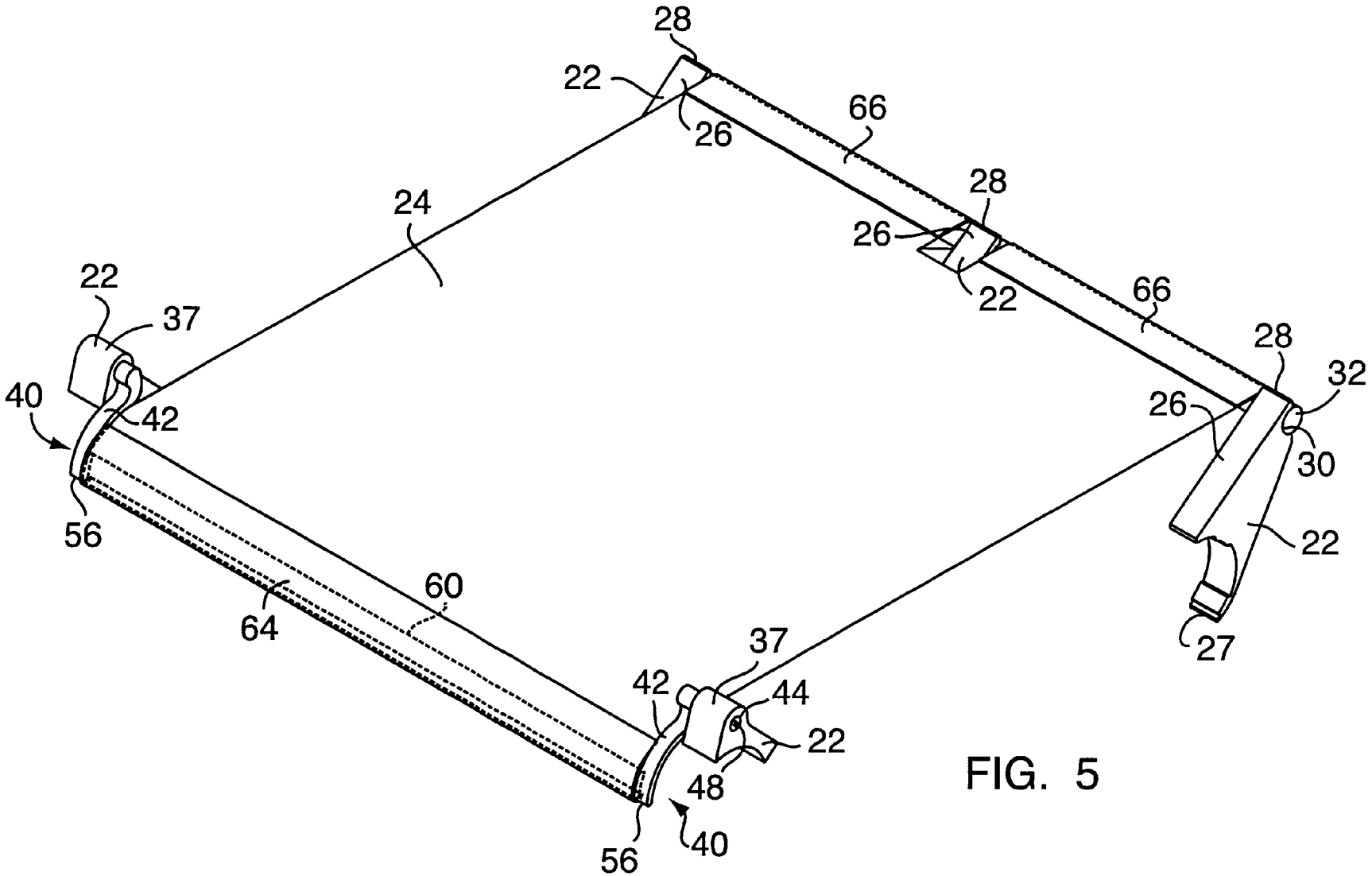
FIG. 5 is a top partial plan view of another embodiment of a seat assembly employing j-channels.

In the alternate embodiment shown in FIG. 4, the diaphragm may be removed by disengaging the J-clips 62 from the lever connecting rod 60. As shown in the alternate embodiment of FIG. 5, the diaphragm 24 may be removed from the lever connecting rod 60 by opening the over center linkage 40 and disengaging the front j-channel 64 from the lever connecting rod 60, and disengaging the rear j-channel 66 from the rear support rod 32.

While a seat assembly for a seat bottom frame has been shown, the present invention is not limited in this regard, as the seat assembly may be used for other sections of a chair, such as the back section of a chair, without departing from the broader aspects of the present invention. While a seat assembly for an airplane seat has been shown, the present invention is not limited in this regard, as the seat assembly may be used for other types of seats, such as automobile seats, foldable seats and portable seats, without departing from the broader aspects of the present invention. The use of the present invention with chair frame or seat bottom frame consisting of one seat member, where the member may be circular, oval, or any other form, is considered within the scope of the invention.

In view of the wide variety of embodiments to which the principles of our invention can be applied, it should be understood that the illustrated embodiments are exemplary only, and should not be taken as limiting the scope of our invention. Rather, we claim as our invention all such embodiments as come within the scope and spirit of the following claims and equivalents thereto.

What is claimed is:

1. A seat assembly, comprising:

a chair frame with spaced supports for holding a diaphragm to said frame, said diaphragm having one edge connected to one of said spaced supports of said chair frame, and an opposite edge of said diaphragm adjacent to another of said spaced supports of said chair frame; and an over center linkage for releasably coupling said opposite edge of said diaphragm to said another of said spaced supports of said chair frame for stretching said diaphragm between said spaced supports of said chair frame, said over center linkage including a pin coupled with said another of said spaced supports for pivotal movement, and a lever arm having a pivot end coupled to said pin for pivotally opening and dosing said over center linkage, and said lever arm having a free end for coupling to said diaphragm, wherein said lever arm moves between a closed position for stretching said diaphragm, and an open position for releasing said diaphragm, wherein said diaphragm is held in the stretched position by mechanical forces.

2. The seat assembly of claim 1, wherein said chair frame is a seat bottom frame.

3. The seat assembly of claim 1, wherein said lever arm unobtrusively conforms to a partial circumference of said chair frame when said over center linkage is in a closed position.

4. The seat assembly of claim 1, wherein said spaced supports include:

a rear support having a mounted end and a free end, said rear support coupled to said chair frame at said mounted end and coupled to said diaphragm at said free end; and a front support having a mounted end coupled to said chair frame, said front support containing said over center linkage for coupling to said opposite edge of said diaphragm.

5. The seat assembly of claim 1, further including:

a plurality of over center linkages each coupled to said chair frame; and a lever connecting rod coupled between said free end of each said lever arm for coupling to said diaphragm.

6. The seat assembly of claim 5, wherein said lever connecting rod is coupled to a j-channel attached to said opposite edge of said diaphragm for easy installation and maintenance.

7. The seat assembly of claim 5, wherein said lever connecting rod is coupled to a sleeve provided in said opposite edge of said diaphragm for easy installation and maintenance.

8. The seat assembly of claim 5, wherein said lever connecting rod is coupled to j-clips attached to said opposite edge of said diaphragm for easy installation and maintenance.

9. The seat assembly of claim 1, wherein-said mechanical forces include said over center linkage retained in a dosed position by abutment of said lever arm against said chair frame, and pressure exerted upon said lever arm by said stretched diaphragm.

10. An apparatus for releasably retaining a diaphragm to be used as a seat for a chair having a frame member, comprising:

a diaphragm;

a means for securing an edge of said diaphragm to a location on a frame member; and an over center linkage coupled to another edge of said diaphragm, said over center linkage for mounting to another location on the frame member, said over center linkage for moving between a closed position wherein said diaphragm is stretched, and an open position, wherein said diaphragm is unstretched, and wherein said over center linkage includes a support for coupling to the frame member of the chair, a pin coupled to said support for providing pivotal movement, and a lever arm having a pivot end coupled to said pin, and a free end for coupling to said diaphragm, said lever arm for moving between an open position wherein said diaphragm is unstretched, and a closed position wherein said diaphragm is stretched.

11. The apparatus of claim 10, wherein said over center linkage is retained in a closed position by abutment of said lever arm against said frame member and pressure exerted upon said lever arm by said stretched diaphragm.

12. A seat assembly having a seat bottom frame and a flexible diaphragm, comprising:

means for fixedly connecting one edge of a diaphragm to a first location of a chair frame;

means for coupling an over center linkage to a second location of the chair frame, said over center linkage including a pin for pivotal movement, and a lever arm having a pivot end coupled to said pin for pivotally opening and closing said over center linkage;

means for releasingly coupling another edge of said diaphragm to said over center linkage;

means for stretching said diaphragm between said first and said second locations of said chair frame; and means for retaining said diaphragm in a stretched position.

* * * * *